US009415524B2

(12) United States Patent
Nagura et al.

(10) Patent No.: US 9,415,524 B2
(45) Date of Patent: Aug. 16, 2016

(54) ROTARY CUTTER DEVICE

(71) Applicant: BROTHER KOGYO KABUSHIKI KAISHA, Nagoya-shi, Aichi-ken (JP)

(72) Inventors: Masato Nagura, Nagoya (JP); Takashi Takeuchi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 55 days.

(21) Appl. No.: 13/799,465

(22) Filed: Mar. 13, 2013

(65) Prior Publication Data

US 2014/0000430 A1 Jan. 2, 2014

(30) Foreign Application Priority Data

Jun. 27, 2012 (JP) ..... 2012-144712

(51) Int. Cl.
*B26D 7/18* (2006.01)
*B26D 1/38* (2006.01)

(52) U.S. Cl.
CPC .. *B26D 7/18* (2013.01); *B26D 1/38* (2013.01); *Y10T 83/2107* (2015.04)

(58) Field of Classification Search
CPC ..... B26D 7/18; B26D 1/38; Y10T 83/2107
USPC ..... 83/116, 113, 117, 118
See application file for complete search history.

(56) References Cited

U.S. PATENT DOCUMENTS 1,738,076 A * 12/1929 Molins ..... 83/116
3,143,016 A * 8/1964 Obenshain ..... 83/98
3,946,627 A * 3/1976 Hofmann ..... 83/117
5,363,728 A * 11/1994 Elsner et al. ..... 83/23
5,806,392 A * 9/1998 Cleall et al. ..... 83/155
6,012,371 A * 1/2000 Nishigaki ..... 83/611
6,142,049 A * 11/2000 Schweitzer et al. ..... 83/349
6,145,561 A * 11/2000 Watanabe et al. ..... 156/517
6,269,720 B1 * 8/2001 Pelagatti ..... 83/343
6,705,784 B2 3/2004 Furuya et al.
6,925,918 B1 * 8/2005 Bunge ..... 83/116
7,044,040 B1 * 5/2006 Smith ..... 83/115
7,156,568 B2 * 1/2007 Miyasaka ..... 400/621
8,128,217 B2 * 3/2012 Adams et al. ..... 347/104

FOREIGN PATENT DOCUMENTS

JP 2002104716 4/2002
JP 3118218 1/2006

OTHER PUBLICATIONS

Office Action issued in Japanese Application No. 2012-144712 on Feb. 15, 2016.

* cited by examiner

*Primary Examiner* — Omar Flores Sanchez
(74) *Attorney, Agent, or Firm* — McCarter & English, LLP

(57) ABSTRACT

A rotary cutter device has a rotator having a rotary blade including a first blade edge part, and a holding body having a fixed blade including a second blade edge part. The first blade edge part and the second blade edge part are rubbed with each other so as to cut. A rotation-side separating member is brought into contact with the cut object in which a cut portion of the cut object adheres to the first blade edge part and rotating together with the rotary blade from inside in the radial direction and applying a reaction force to the outside. A fixed-side separating member is fixed so as to be located outside a rotation range of the first blade edge part, and is brought into contact with the cut object from outside in the radial direction and constrains movement of the cut object to the outside.

4 Claims, 16 Drawing Sheets

COMPARATIVE EXAMPLE

EMBODIMENT

VARIATION

ROTARY CUTTER DEVICE

CROSS-REFERENCE TO RELATED APPLICATION

The present application claims priority from Japanese Patent Application No. 2012-144712, which was filed on Jun. 27, 2012, the disclosure of which is incorporated herein by reference in its entirety.

BACKGROUND

1. Field

The present disclosure relates to a rotary cutter device for cutting an object to be cut.

2. Description of the Related Art

A rotary cutter device which can cut an object to be cut which is being fed without stopping the feeding has been already known. The rotary cutter device of this prior art has a rotator on which a spiral blade is provided on an outer periphery of a cylindrical body part. By having each part of the blade of the rotator sequentially cut into the object to be cut, the object to be cut having been fed on an introduction path to the rotator is cut linearly.

SUMMARY

The present disclosure has an object to provide a rotary cutter device which can ensure a subsequent smooth cutting operation by peeling off the adhering cut object from the blade edge even if the cut object adheres to the blade edge of the blade on the rotator.

In order to achieve the above-described object, according to the aspect of the present application, there is provided a rotary cutter device comprising a housing, a rotator supported by the housing rotatably in a predetermined rotating direction and having a rotary blade including a first blade edge part, and a holding body supported by the housing and having a fixed blade including a second blade edge part, wherein the first blade edge part is brought into contact with the second blade edge part from one side in the rotating direction and the first blade edge part and the second blade edge part are rubbed with each other so as to cut an object to be cut located in a path passing through the vicinity of the second blade edge part to have a cut object, and a rotation-side separating member is provided on the rotator by a predetermined delay phase angle from the rotary blade and brought into contact with the cut object in which a cut portion of the cut object adheres to the first blade edge part during the cutting and rotating together with the rotary blade from inside in the radial direction and applying a reaction force to the outside in the radial direction, and a fixed-side separating member is fixed to the housing so as to be located outside a rotation range of the first blade edge part of the rotator and in the vicinity of a rotation radius of the first blade edge part, and is brought into contact with the cut object from outside in the radial direction and constrains movement of the cut object to the outside in the radial direction.

DESCRIPTION OF THE PREFERRED EMBODIMENTS

An embodiment of the present disclosure will be described below by referring to the attached drawings. This embodiment is an embodiment in which a rotary cutter device of the present disclosure is applied to a label producing device as a printer. In the following description, an up-and-down direction, a front-and-rear direction, and a right-and-left direction correspond to arrow directions illustrated as appropriate in each drawing.

Figure 1:
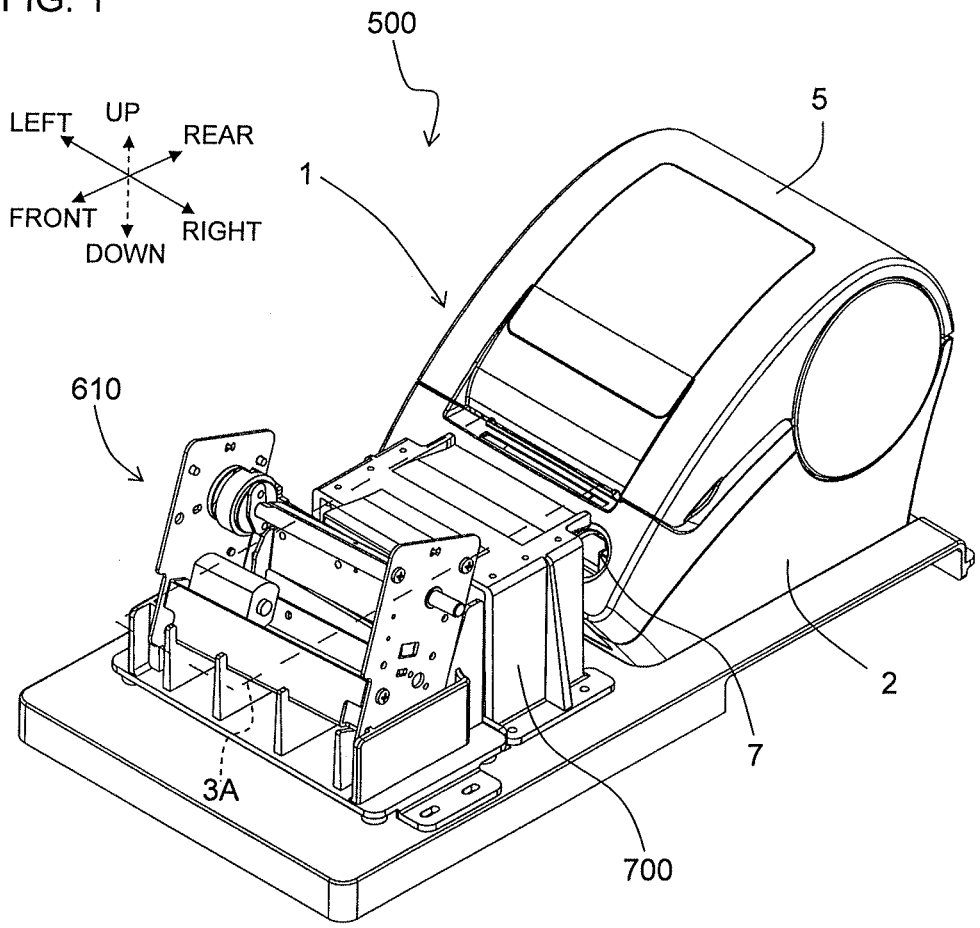
FIG. 1 is a perspective view illustrating an outline configuration of a label producing device provided with a rotary cutter device according to this embodiment.

As illustrated in FIG. 1, a label producing device 500 is provided with a label producing device main body 1 and a rotary cutter device 610.

<Configuration of Label Producing Device Main Body>

A configuration of the label producing device main body 1 will be described by using FIGS. 1, 2, 3A and 3B. In FIGS. 1, 2, 3A and 3B, in order to prevent complexity, a label separating shaft 901, a label separating plate 902, a top plate 903 and the like which will be described later are not illustrated. The label producing device main body 1 is composed of a housing 2, an upper cover 5 made of a transparent resin, a power button 7 arranged on the front side of the housing 2 and the like.

Figure 3A:
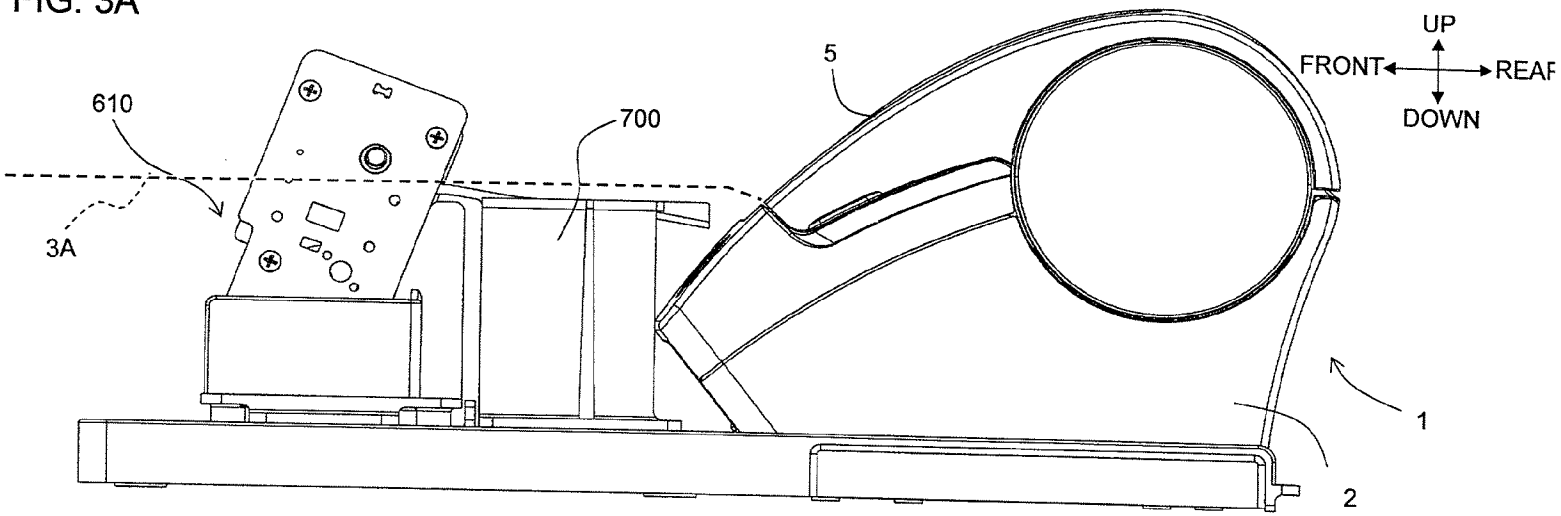
FIG. 3A is a side view of the label producing device illustrated in FIG. 1.
Figure 3B:
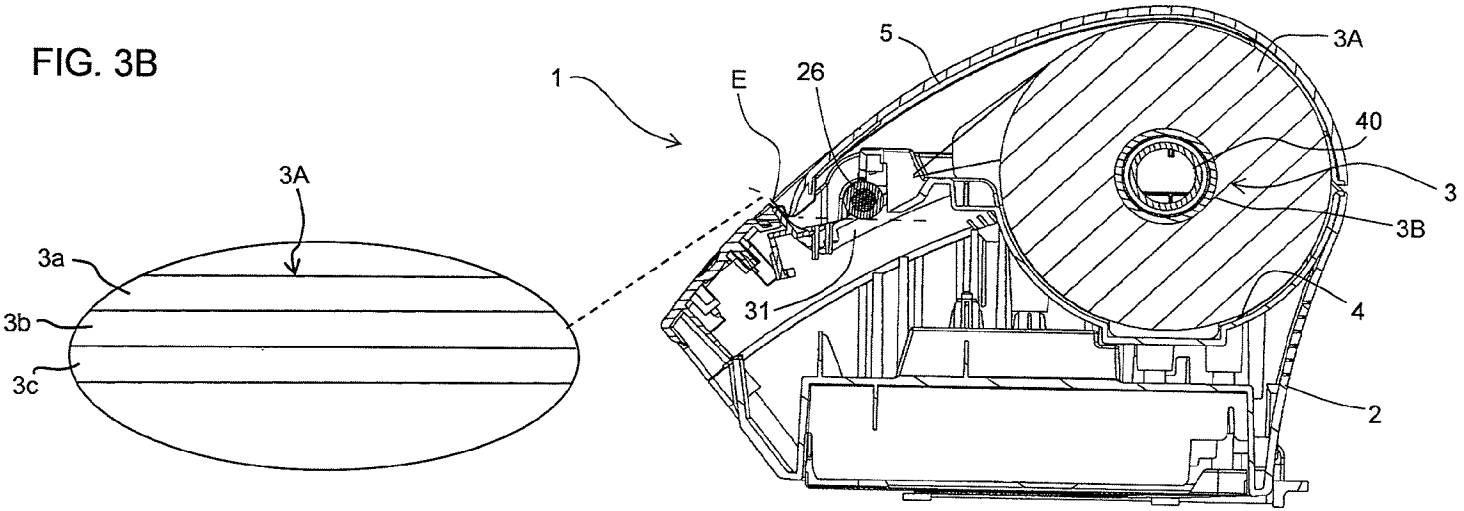
FIG. 3B is a sectional view of the label producing device illustrated in FIG. 1.

As illustrated in FIG. 3B, a tape holder 3 is accommodated and arranged in a tape holder accommodating part 4 provided in the label producing device main body 1. Moreover, the above described upper cover 5 is attached to an upper-end edge portion on the rear side capable of being opened/closed so as to cover the upper side of the tape holder accommodating part 4.

Around the tape holder 3, a label tape 3A (object to be cut) having a predetermined width is rotatably wound. That is, the label tape 3A is wound in a roll shape around a winding core 3B having a predetermined outer peripheral diameter so as to constitute a tape roll. A substantially cylindrical holder shaft member 40 is provided on the inner periphery side of the winding core 3B so as to be arranged in the axial direction.

The label tape 3A has a three-layer structure in this example (See a partial enlarged view in FIG. 3B) and is composed of a separation sheet 3*a*, an adhesive layer 3*b*, and lengthy thermal paper having self-chromogenic properties (so-called thermal paper) 3*c* laminated in this order from the side wound around the outside of the roller (upper side in the partial enlarged view in FIG. 3B) to the opposite side (lower side in the partial enlarged view in FIG. 3B). The separation sheet 3*a* is bonded to the back side (upper side in FIG. 3B) of the thermal paper 3*c* by the adhesive layer 3*b*. This separation sheet 3*a* is configured to be bonded to a desired article or the like by the adhesive layer 3*b* by being separated when a finally completed print label T (See FIGS. 5 and 6 which will be described later) is attached to the article or the like.

Moreover, on the downstream side in a transport direction of a fed-out position from the tape roll of the label tape 3A, a thermal head 31 for applying desired print is provided, and a platen roller 26 is provided at a position opposite to this thermal head 31. The platen roller 26 feeds out the label tape 3A wound around the winding core 3B and feeds it on a feeding path to a discharging exit E.

Figure 4:
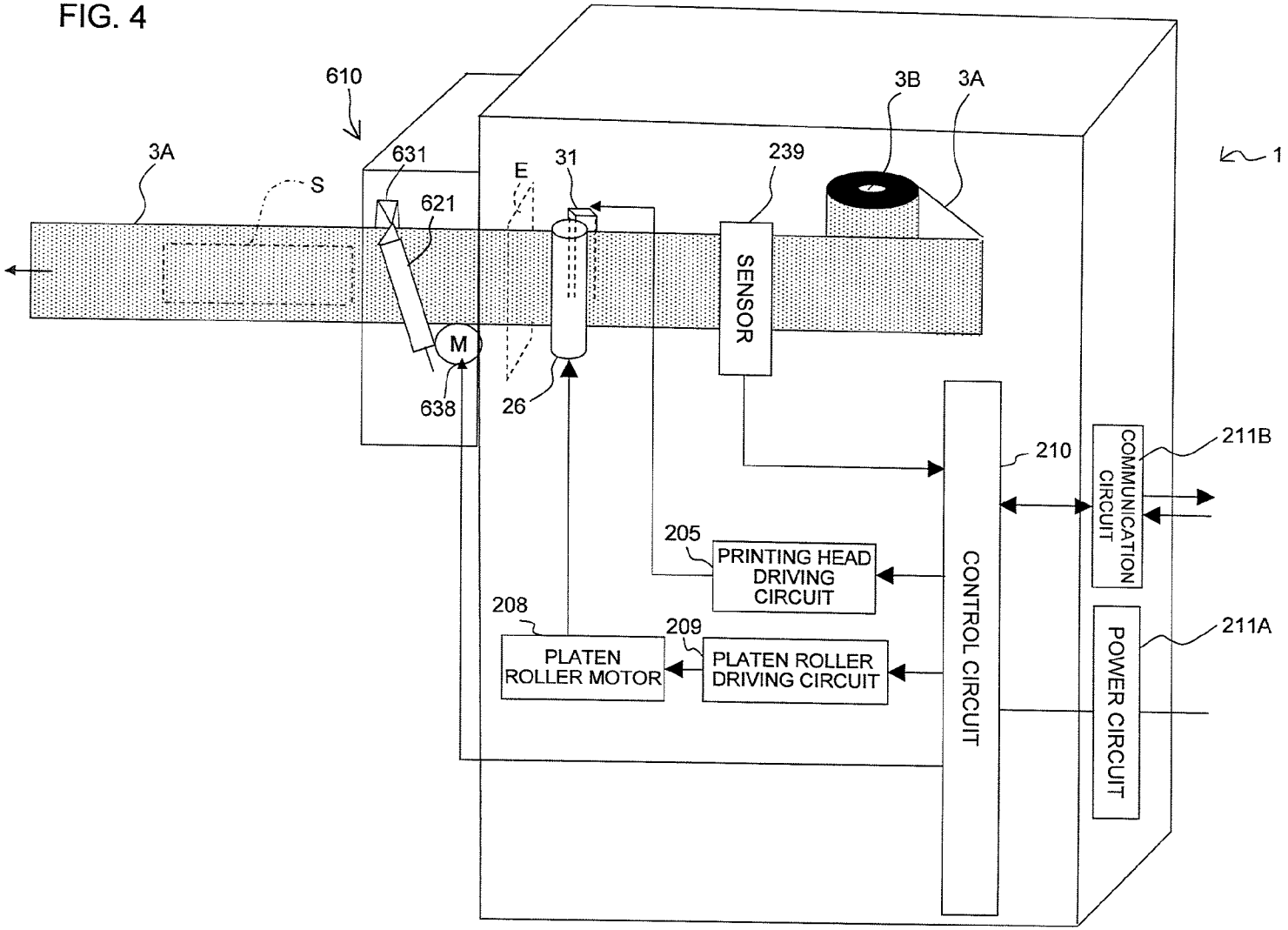
FIG. 4 is a functional block diagram illustrating a control system of a label producing device.

The thermal head 31 is moved downward by rotating a lever (not shown) for its vertical-movement operation upward and brought into a state spaced away from the platen roller 26 and moved upward by rotating the lever downward and brought into a state capable of print by pressing and biasing the label tape 3A onto the platen roller 26. Then, as illustrated in FIG. 4 which will be described later, by rotating and driving the platen roller 26 by platen roller motor 208 such as a pulse motor (or a stepping motor) by means of driving control of the thermal head 31, the desired print is applied to a predetermined print area S (See FIG. 4 which will be described later) provided on the label tape 3A. Then, the label tape 3A with print is discharged through the discharging exit E and cut to a predetermined length by the rotary cutter device 610, whereby the print label T is produced. Broken lines in FIGS. 1, 3A, and 3B indicate the feeding path of the label tape 3A being fed.

As illustrated in FIG. 3A, a guide placing base 700 is installed on the front side of the label producing device main body 1 (on the downstream side in the transport direction from the discharging exit E). The rotary cutter device 610 is arranged further on the downstream side in the transport direction from this guide placing base 700. The guide placing base 700 leads the label tape 3A with print discharged through the discharging exit E into a space between a first flat blade 621 (which will be described later) of the rotary cutter device 610 and a second flat blade 631 (which will be described later).

<Control System of Label Producing Device Main Body>

A control system of the label producing device main body 1 will be described by referring to FIG. 4. In FIG. 4, the label producing device main body 1 includes a sensor 239 for detecting presence of the label tape 3A in the feeding path, a printing head driving circuit 205 for controlling electricity supplied to the thermal head 31, a platen roller motor 208 for driving the platen roller 26, a platen roller driving circuit 209 for controlling this platen roller motor 208, and a control circuit 210 for controlling an operation of the entire label producing device main body 1 through the printing head driving circuit 205, the platen roller driving circuit 209 and the like.

The control circuit 210 is a so-called microcomputer and is composed of a CPU which is a central processing unit, a ROM, a RAM and the like, though the details of which are not shown, and executes signal processing in accordance with a program stored in the ROM in advance while using a temporary storage function of the RAM. Moreover, this control circuit 210 is supplied with electricity by a power circuit 211A and is connected to a communication line, for example, via a communication circuit 211B so that information can be exchanged with a root server, not shown, connected to this communication line, other terminals, a general-purpose computer, an information server and the like. A motor 638 which will be described later of the rotary cutter device 610 arranged on the front side of the label producing device main body 1 is also driven and controlled by the control circuit 210.

Figure 5A:
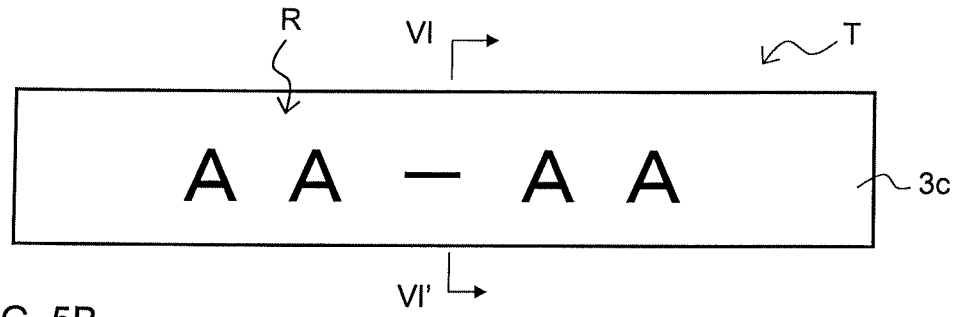
FIG. 5A is a top view illustrating an example of appearance of a print label.
Figure 5B:
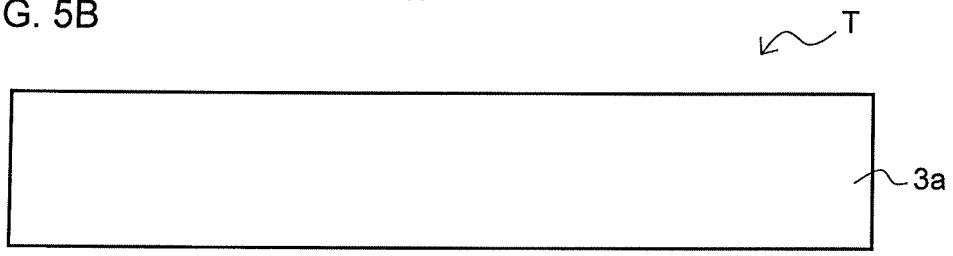
FIG. 5B is a bottom view illustrating an example of appearance of a print label.
Figure 6:
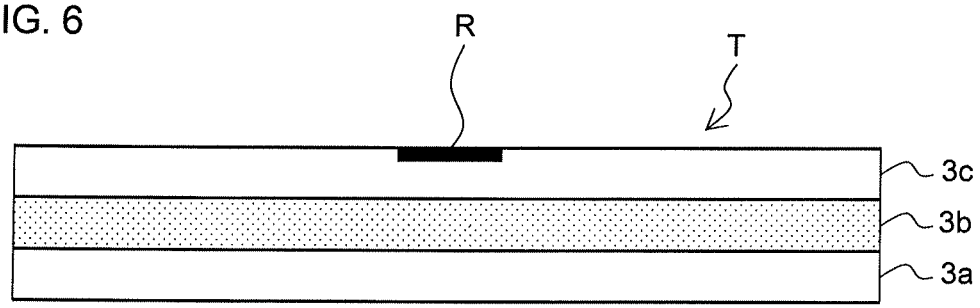
FIG. 6 is a cross-sectional view by a VI-VI' section in FIG. 5A.
Figure 7:
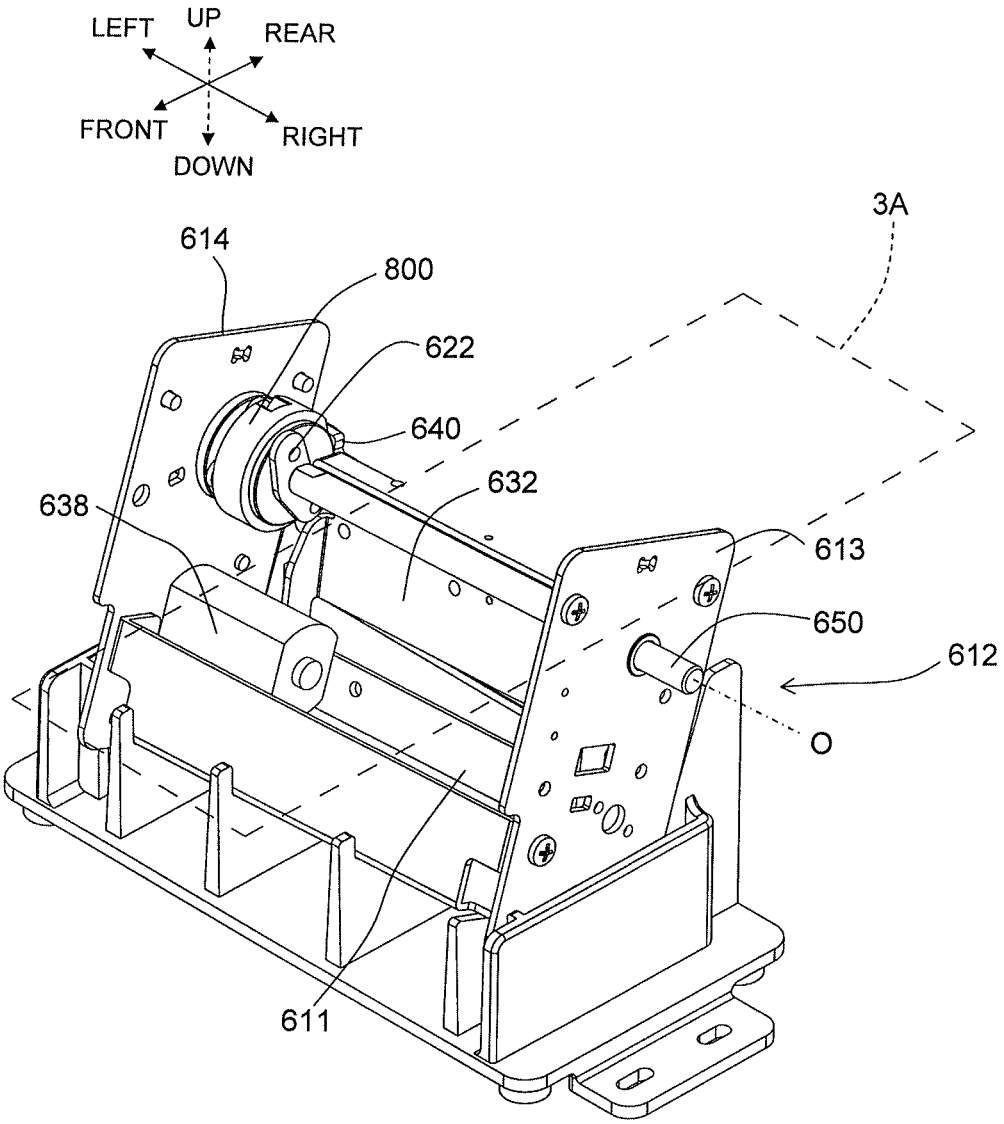
FIG. 7 is a perspective view of the rotary cutter device when seen from diagonally above on the front side.

The print label T formed by completion of cutting of the label tape 3A by the rotary cutter device 610 is illustrated in FIGS. 5A, 5B, and 6. As illustrated, the print label T has the above described three-layer structure having the thermal paper 3*c*, the adhesive layer 3*b*, and the separation sheet 3*a* laminated in this order from the front surface side (upper side in FIG. 6) to the opposite side (lower side in FIG. 6). Then, as illustrated in FIG. 5A, a print R (here, characters of "AA-AA" in this example) is applied on the surface of the thermal paper 3*c*.

<Outline Configuration of Rotary Cutter Device>

Subsequently, the rotary cutter device will be described by referring to FIGS. 7-11. Similarly to the above, in order to prevent complexity in the illustration, the label separating shaft 901, the label separating plate 902, the top plate 903 and the like are not illustrated I FIGS. 7-11. As illustrated in FIGS. 7, 8, 9, 10 and 11, the rotary cutter device 610 is provided with a housing 612, a rotator 620, and a holding body 630. The rotary cutter device 610 performs linear cutting by means of collaboration between the first flat blade 621 (rotary blade) and the second flat blade 631 (fixed blade) on the label tape 3A on which the print is formed by the thermal head 31. The housing 612 has a first wall surface 613 on one side (right side in this example) and a second wall surface 614 on the other side (left side in this example). Moreover, the housing 612 is provided with a connection part 611 connecting the first wall surface 613 and the second wall surface 614 to each other.

Figure 2:
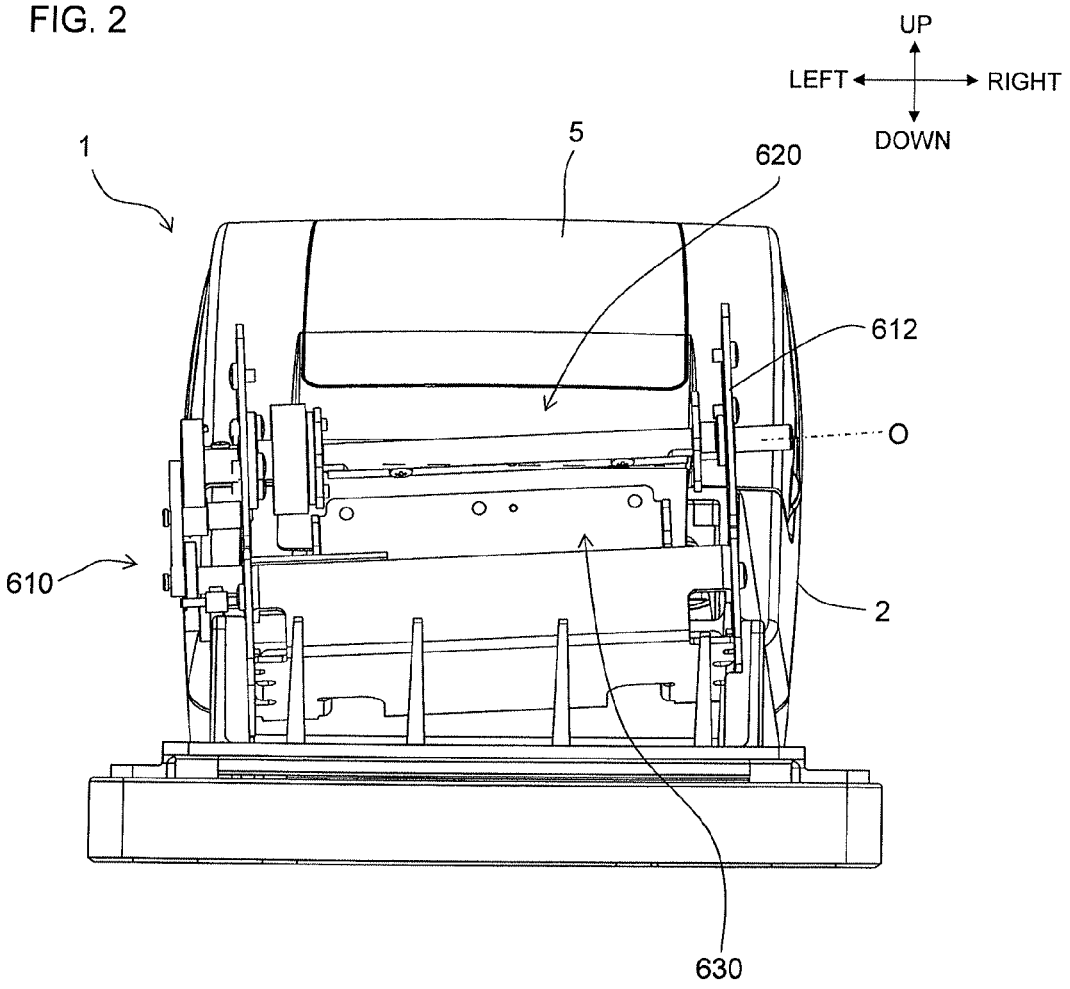
FIG. 2 is a front view of the label producing device illustrated in FIG. 1.
Figure 8A:
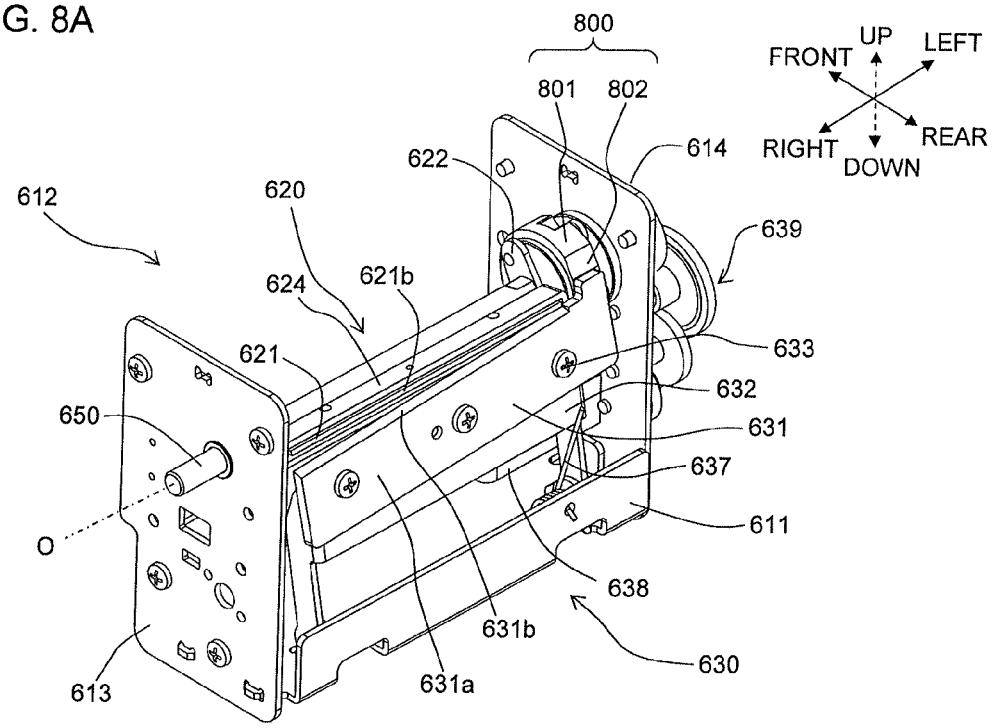
FIG. 8A is a perspective view of the rotary cutter device when seen from diagonally above on the back surface side.
Figure 8B:
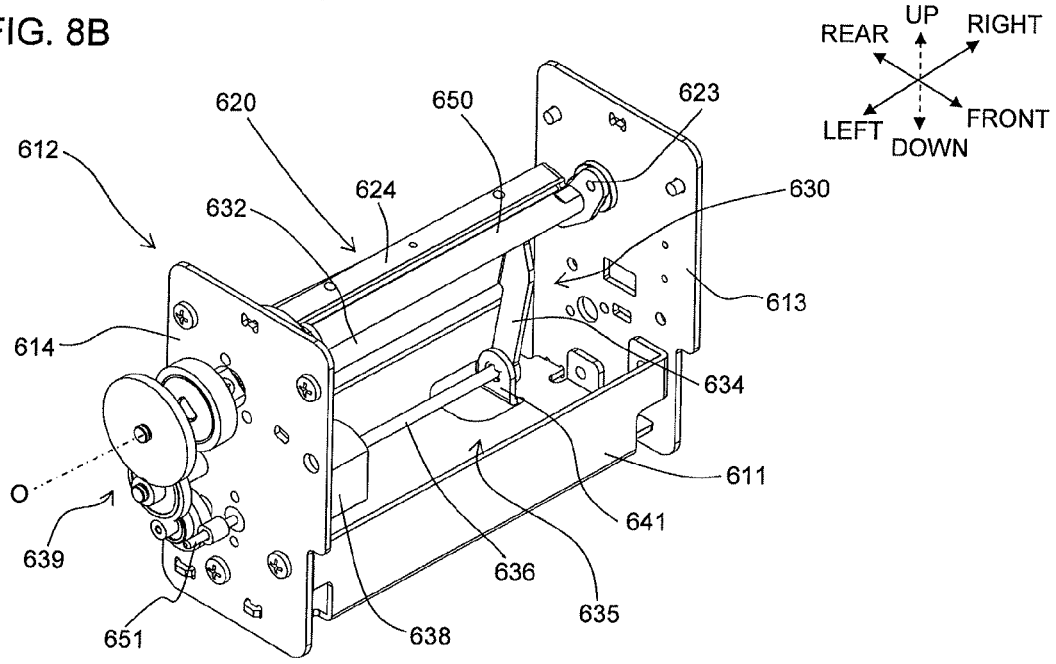
FIG. 8B is a perspective view of the rotary cutter device when seen from diagonally above on the front side.
Figure 9A:
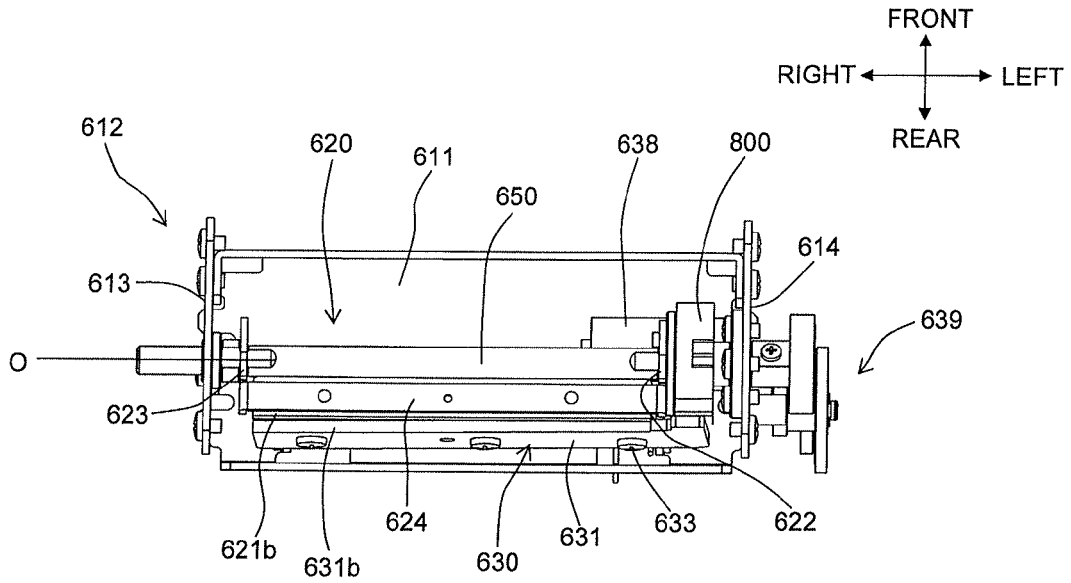
FIG. 9A is a plan view of the rotary cutter device.
Figure 9B:
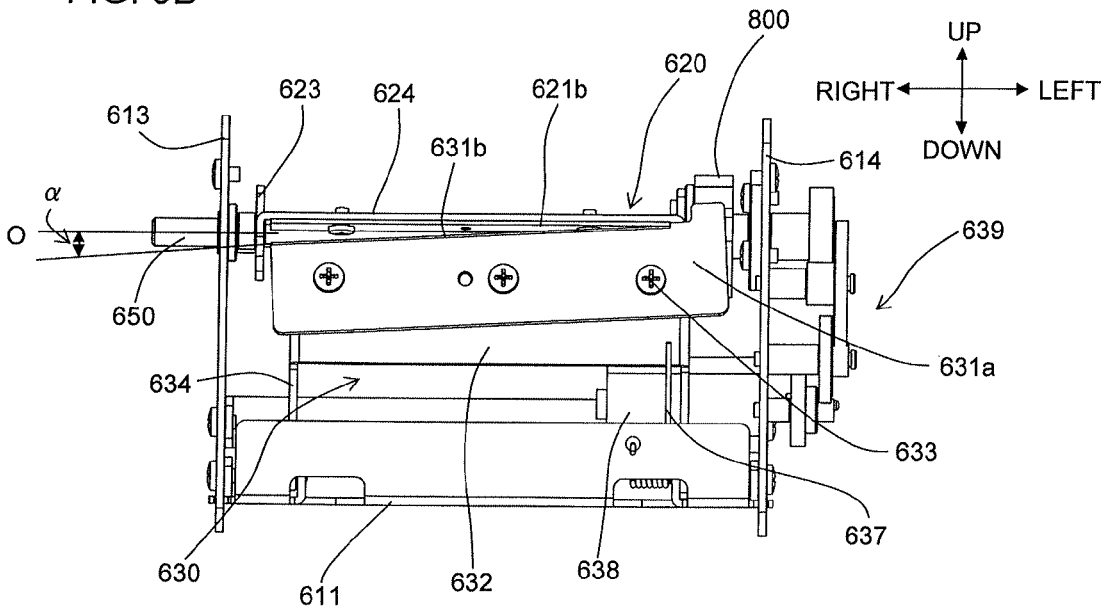
FIG. 9B is a rear view of the rotary cutter device.

As illustrated in FIGS. 1 and 2, the rotary cutter device 610 is arranged with surface directions of the first wall surface 613 and the second wall surface 614 of the housing 612 inclined slightly to the left side from the vertical direction, but for convenience of explanation and ease of understanding the illustration, the housing 612 is illustrated with a posture returned to the vertical direction in FIGS. 8A and 9B.

<Configuration of Rotator>

The rotator 620 is provided with a first bracket 622 on one side, a second bracket 623 on the other side, a rotary shaft 650 (rotary shaft member) provided so as to connect the first bracket 622 and the second bracket 623 to each other and rotatably on the housing 612 around a rotation axis O, and a flat-blade mounting part 624 provided on the rotary shaft 650 and attached with the first flat blade 621 as a rotary blade.

The first flat blade 621 is provided with a first blade edge part 621*b* extending linearly on an edge portion of a first base part (not shown) having a substantially plate shape. At this time, the first blade edge part 621*b* is, as illustrated in FIGS. 8A, 9B and the like, supported by the flat-blade mounting part 624 and the rotary shaft 650 so as to be parallel with the rotation axis O. When the rotator 620 rotates, the first blade edge part 621*b* draws a cylindrical rotation trajectory r (corresponding to a rotation range. See FIG. 15 which will be described later) around the rotation axis O.

<Configuration of Holding Body>

The holding body 630 has a plate-shaped holding part 632 provided with the second flat blade 631 as a fixed blade. Moreover, the holding part 632 is provided with extending parts 634 and 634 on the both right and left end portions and is supported by a swing support mechanism 635 (See FIG. 8B) through the extending parts 634 and 634 capable of swing with respect to the housing 612.

The swing support mechanism 635 is provided with a pair of right and left hinge arms 641 and 641 installed upright on the connection part 611 of the housing 612, a support shaft 636 to the both ends of which the extending parts 634 of the holding part 632 are fixed, and a coil-shaped coil spring 637 arranged around the support shaft 636. The holding part 632 is made capable of swing to the front and rear with respect to the housing 612 by having the support shaft 636 fixed to the extending parts 634 and 634 supported rotatably by the hinge arms 641. At this time, as illustrated in FIG. 8A, one end (rear end) of the coil spring 637 is fixed to the connection part 611, while the other end (upper end) of the coil sprint 637 is brought into contact with a rear portion of the holding part 632, and as a result, the coil spring 637 biases the holding part 632 to the front (in other words, in a reaction toward the rotator 620). As a result, the holding part 632 is supported capable of swing with respect to the housing 612.

The second flat blade 631 is, as illustrated in FIG. 9B and the like, provided with a substantially plate-shaped second base part 631*a* and a second blade edge part 631*b* extending linearly on the edge portion of this second base part 631*a*. The second flat blade 631 is held by the holding part 632 having the second base part 631*a* fixed by a mounting screw 633. At this time, the holding part 632 is arranged capable of swing as described above, and the holding part 632 holds the second flat blade 631 so that the second blade edge part 631*b* of the second flat blade 631 is not in parallel (skew position) with the rotation axis O in any swing state. In detail, in any swing state of the holding part 632, the planar direction of the second base part 631*a* of the second flat blade 631 (that is, the mounting surface direction of the second flat blade 631) is in parallel with the rotation axis O with a predetermined interval (See FIGS. 9A and 9B). Moreover, in any swing state of the holding part 632, the second flat blade 631 is disposed such that a straight line including the second blade edge part 631*b* and the rotation axis O form a predetermined angle $\alpha$ as illustrated in FIG. 9B when seen from the front (in other words, when seen from the side face direction orthogonal to the planar direction of the second base part 631*a*). Since the rotation axis O and the first blade edge part 621*b* are in parallel with each other all the time, an inclination angle (so-called shear angle) formed when the first blade edge part 621*b* and the second blade edge part 631*b* are brought into contact with each other matches this angle $\alpha$. Particularly, the second blade edge part 631*b* is held so as to extend linearly in a feeding surface of a feeding path of the label tape 3A during the cutting operation.

As the result of the above, the first flat blade 621 is supported by the flat-blade mounting part 624 so that the cylindrical rotation trajectory r drawn by the first blade edge part 621*b* when the rotator 620 rotates is in contact with the second blade edge part 631*b*, while the second flat blade 631 is held by the holding part 632. As a result, such a positional relationship is formed that the second blade edge part 631*b* of the second flat blade 631 becomes oblique to an outer edge line of the cylindrical rotation trajectory r around the rotation axis O.

Figure 10A:
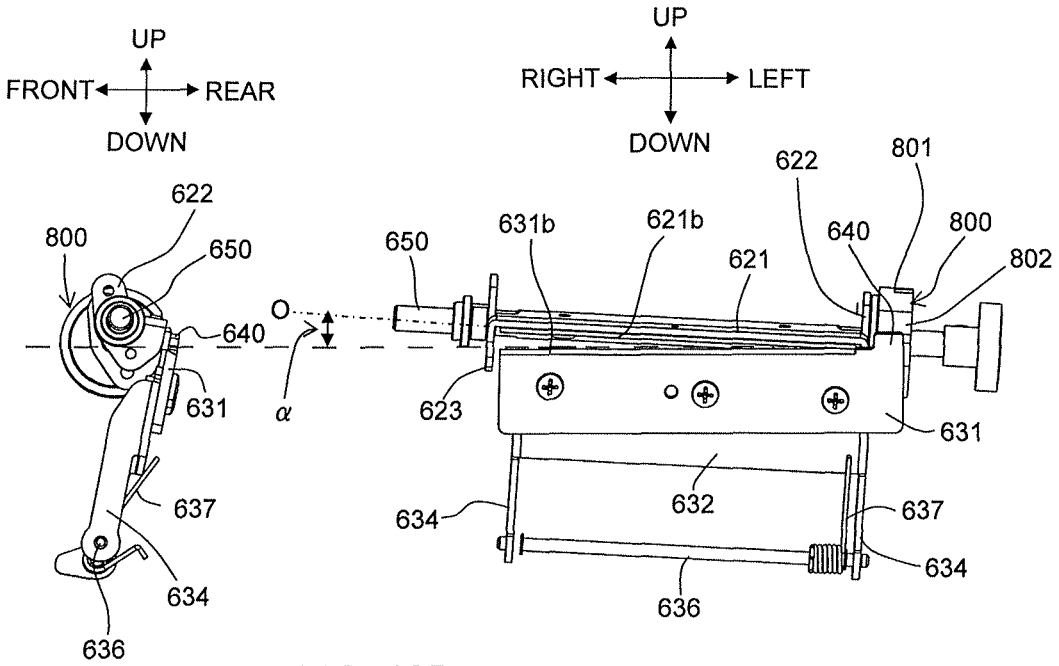
FIG. 10A is a rear view and a side view illustrating a configuration of an essential part of an embodiment of the present disclosure in which a rotation axis of a rotator is arranged diagonally with respect to a horizontal holding body.
Figure 10B:
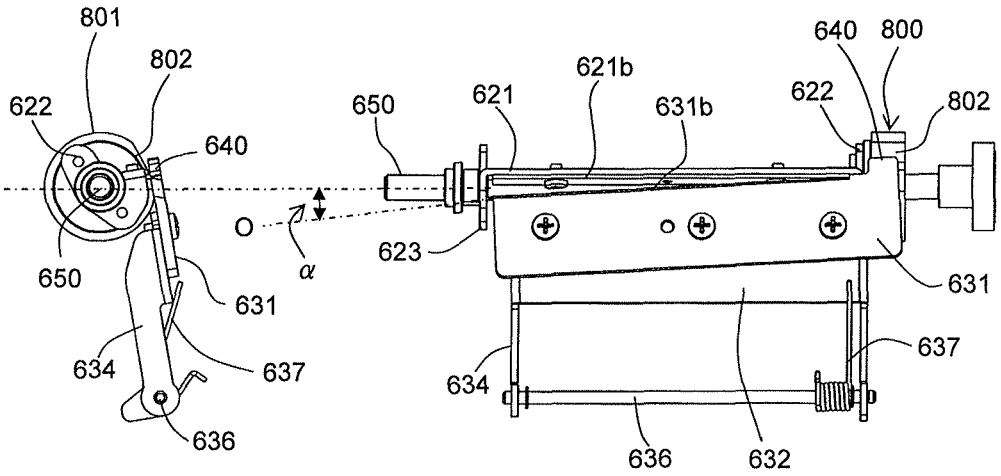
FIG. 10B is a rear view and a side view illustrating a variation in which the holding body is arranged diagonally with respect to a rotation axis of the horizontal rotator.

In this embodiment, as illustrated in FIG. 10A, the rotator 620 and the holding body 630 are arranged so that the feeding path of the label tape 3A (in other words, the second blade edge part 631*b*) becomes horizontal and the rotation axis O of the rotator 620 is inclined with respect to the horizontal direction, but this is not limiting. That is, as illustrated in FIG. 10B, the rotator 620 and the holding body 630 may be arranged so that, when seen from the front side, the rotation axis O of the rotator 620 becomes horizontal and the feeding path of the label tape 3A (in other words, the second blade edge part 631*b*) is inclined with respect to the horizontal direction.

<Transmission of Driving Force>

On the other hand, as illustrated in FIGS. 7, 8A, 8B, 9A, and 9B, the motor 638 functioning as the rotation driving unit rotating and driving the rotator 620 is provided below the second wall surface 614 side of the housing 612. In correspondence with that, a driving transmission mechanism 639 formed of a gear train capable of operating and connecting between a driving shaft 651 of the motor 638 (See FIG. 8B) penetrating the second wall surface 614 and the rotary shaft 650 of the rotator 620 penetrating the second wall surface 614 is provided on an outer surface of the second wall surface 614. The motor 638 rotates the rotator 620 via the driving transmission mechanism 639 in a direction where the first blade edge part 621*b* of the first flat blade 621 is approaching the second blade edge part 631*b* of the second flat blade 631 from above (See FIG. 11B). As a result, the label tape 3A inserted between the rotator 620 and the holding body 630 is cut in the running state (without stopping the feeding).

Figure 11A:
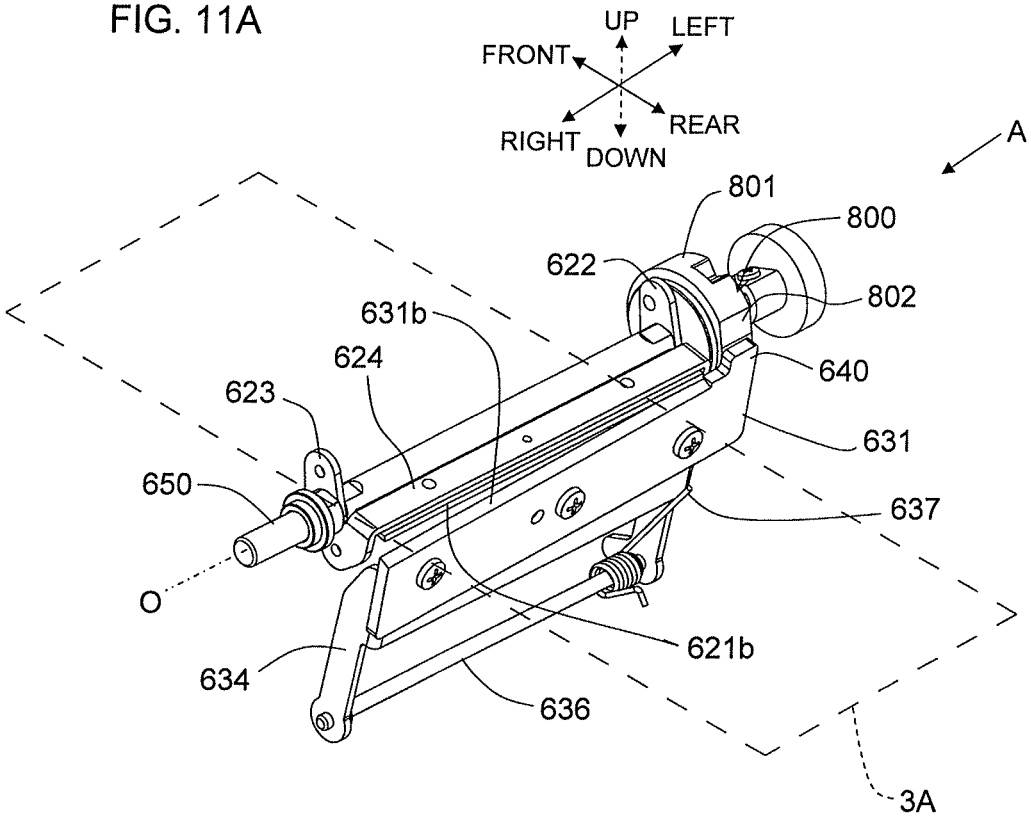
FIG. 11A is a perspective view of an essential part of the rotary cutter device.
Figure 11B:
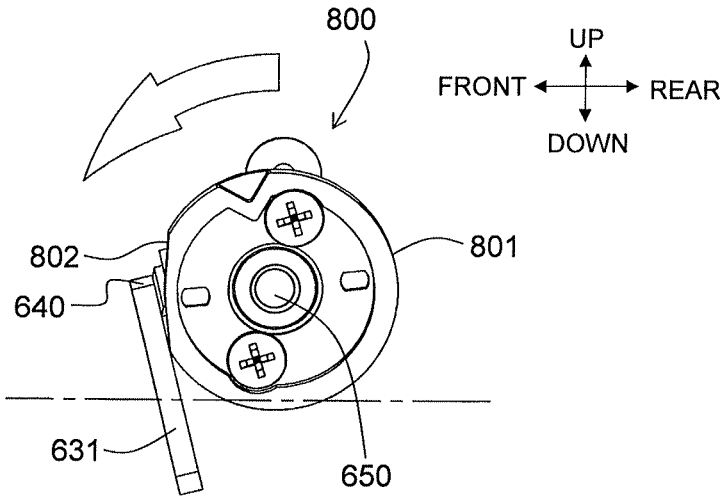
FIG. 11B is an A direction in FIG. 11A illustrating an introduction mode of a label tape into a space between the rotator and the holding body.

At this time, as illustrated in FIG. 9, a rotation cam 800 having a substantially D-shape when seen on a side view is fixed to one end (left end in this example) of the rotary shaft 650 of the first rotator 620. As illustrated in FIGS. 11A and 11B, a contacted part 640 having a projecting piece shape is formed on an upper end portion located on the left side of the second blade edge part 631*b* in the second flat blade 631. This contacted part 640 is pressed into contact and engaged with the rotation cam 800 in the swing state by a biasing force of the coil spring 637.

The rotation cam 800 is, as illustrated in FIGS. 11A and 11B, provided with a first circumferential region (corresponding to an arc portion of the D-shape) 801 and a second circumferential region (corresponding to a linear portion of the D-shape) 802. The rotation cam 800 presses the contacted part 640 to the rear by the first circumferential region 801 at a rotation position where the first circumferential region 801 is opposed to the contacted part 640. As a result, the rotation cam 800 moves the holding body 630 so that the second blade edge part 631*b* separates from the rotation trajectory of the entire first rotator 620. On the other hand, the rotation cam 800 is brought into a non-contact state with the contacted part 801 (by means of friction between the first blade edge part 621*b* of the first flat blade 621 which will be described later and the second blade edge part 631*b* of the second flat blade 631) in a state where the second circumferential region 802 is opposed to the contacted part 640 and releases the holding body 630 (state illustrated in FIG. 11B).

<Cutting Operation>

An operation of the rotary cutter device 610 will be described by referring to FIG. 12. As described above, in this embodiment, such a positional relationship is formed that the second blade edge part 631*b* of the second flat blade 631 becomes oblique to the outer edge line of the cylindrical rotation trajectory r around the rotation axis O drawn by the first blade edge part 621*b* when the rotator 620 rotates. As a result, in the first blade edge part 621*b* having rotated on the rotation trajectory r, one end portion (left end portion in this example) of the linear shape approaches the second blade edge part 631*b* first and then, a portion approaching the second blade edge part 631*b* gradually moves linearly to the right from the left end portion. FIGS. 12A-12E sequentially illustrate the behavior at this time.

Figure 12A:
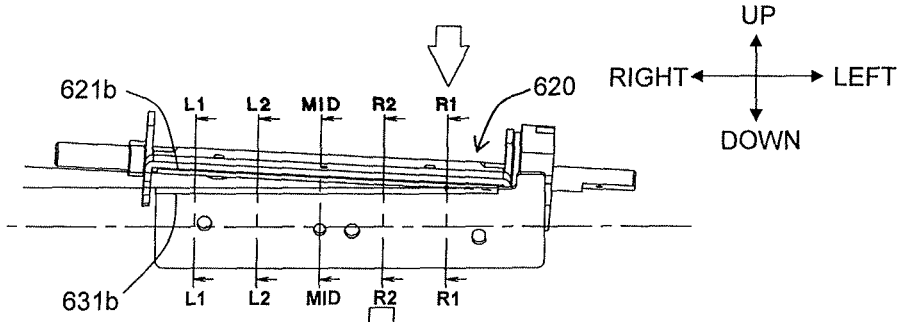
FIG. 12A is an explanatory diagram illustrating a course of cutting of the label tape realized by friction between a first blade edge part of a first cutting blade of the rotator and a second blade edge part of a second cutting blade of the holding body.

That is, FIG. 12A illustrates a state in which a portion expressed by an R1-R1section close to the left end portion of the first blade edge part 621 is brought into contact with and rubbed by the second blade edge part 631*b* (See a white arrow). For convenience of explanation, a posture of the rotator 620 (rotation angle) in this state is assumed to have a rotation phase of "0°".

Figure 12B:
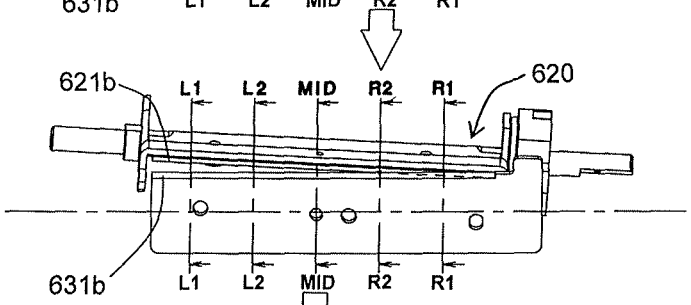
FIG. 12B is an explanatory diagram illustrating a course of cutting of the label tape realized by friction between a first blade edge part of a first cutting blade of the rotator and a second blade edge part of a second cutting blade of the holding body.

After that, in FIG. 12B in which rotation of the rotator 620 has progressed, a portion expressed by an R2-R2 section slightly shifted to the right side from the R1-R1 section of the first blade edge part 621 is brought into contact with and rubbed by the second blade edge part 631*b* (See a white arrow). The rotation phase of the rotator 620 at this time is "4°", for example.

Figure 12C:
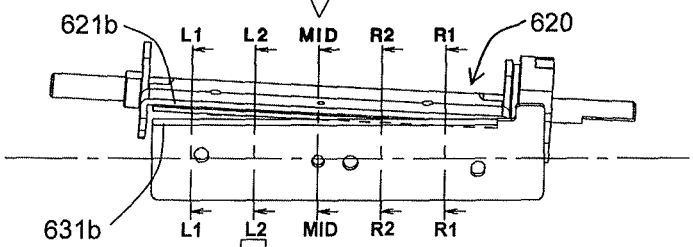
FIG. 12C is an explanatory diagram illustrating a course of cutting of the label tape realized by friction between a first blade edge part of a first cutting blade of the rotator and a second blade edge part of a second cutting blade of the holding body.

After that, in FIG. 12C in which rotation of the rotator 620 has further progressed, a portion expressed by an MID-MID section at the center portion in the right-and-left direction slightly shifted to the right side from the R2-R2 section of the first blade edge part 621 is brought into contact with and rubbed by the second blade edge part 631*b* (See a white arrow). The rotation phase of the rotator 620 at this time is "8°", for example.

Figure 12D:
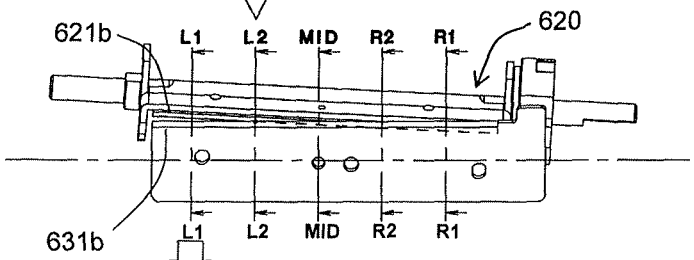
FIG. 12D is an explanatory diagram illustrating a course of cutting of the label tape realized by friction between a first blade edge part of a first cutting blade of the rotator and a second blade edge part of a second cutting blade of the holding body.

After that, in FIG. 12D in which rotation of the rotator 20 has further progressed, a portion expressed by an L2-L2 section slightly shifted to the right side from the MID-MID section of the first blade edge part 621 is brought into contact with and rubbed by the second blade edge part 631*b* (See a white arrow). The rotation phase of the rotator 620 at this time is "12°", for example.

Figure 12E:
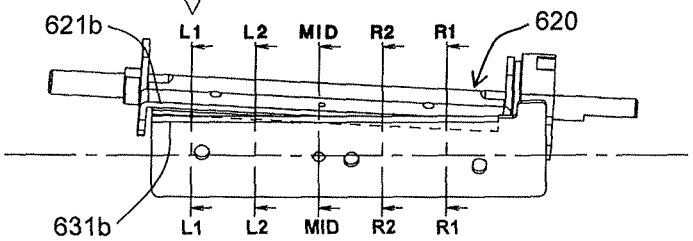
FIG. 12E is an explanatory diagram illustrating a course of cutting of the label tape realized by friction between a first blade edge part of a first cutting blade of the rotator and a second blade edge part of a second cutting blade of the holding body.

After that, in FIG. 12E in which rotation of the rotator 620 has further progressed, a portion expressed by an L1-L1 section close to the right end portion and slightly shifted to the right side from the L2-L2 section of the first blade edge part 621 is brought into contact with and rubbed by the second blade edge part 631*b* (See a white arrow). The rotation phase of the rotator 620 at this time is "16°", for example.

By introducing the label tape 3A to a contact portion between the first blade edge part 621*b* and the second blade edge part 631*b* gradually moving as described above, after the cutting into the label tape 3A on the left end portion is started, the label tape 3A can be gradually cut ahead linearly to the right. At this time, since the above described angle a functions as a shear angle, cutting can be smoothly accomplished with a relatively small shearing force.

<Essential Part of this Embodiment>

In the above described configuration, the essential part of this embodiment is that the label tape 3A adhering to the first blade edge part 621*b* by the adhesive layer 3*b* is peeled off during cutting of the label tape 3A described above so as to ensure a smooth cutting operation. The details will be described below by referring to FIGS. 13-15.

<Label Separating Shaft, Label Separating Plate, and Top Plate>

Figure 13A:
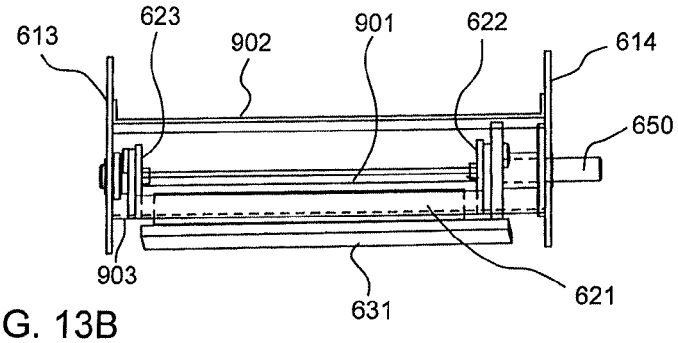
FIG. 13A is a plan view of the rotary cutter device of the embodiment provided with a label separating shaft and a label separating plate.
Figure 13B:
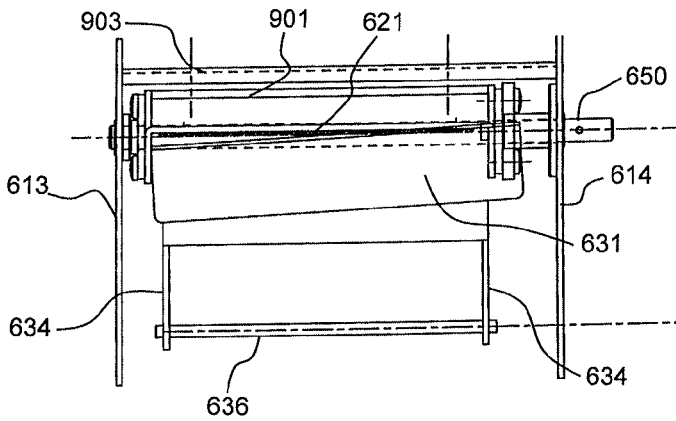
FIG. 13B is a front view of the rotary cutter device of the embodiment provided with a label separating shaft and a label separating plate.
Figure 13C:
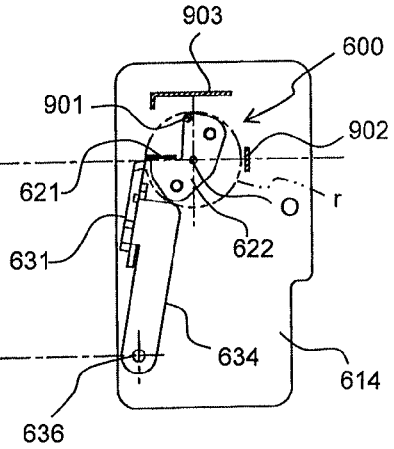
FIG. 13C is a side view of the rotary cutter device of the embodiment provided with a label separating shaft and a label separating plate.

As illustrated in FIGS. 13A-13C, in this embodiment, the label separating shaft 901 (rotation-side separating member) is extended between the first bracket 622 on one side and the second bracket 623 on the other side in the rotator 620 provided with the first flat blade 621. At this time, this label separating shaft 901 is arranged so as to rotate with a delay of a predetermined delay phase angle (approximately 90° in this example) from the first flat blade 621 (See also FIG. 13C and FIG. 15 which will be described later).

Moreover, the label separating plate 902 (fixed-side separating member) is fixed to the housing 612 so as to be outside of the rotation trajectory r which is a rotation range of the first blade edge part 621*b*. This label separating plate 902 is extended between the first wall surface 613 and the second wall surface 614 of the housing 612 so as to be in the vicinity of a rotation radius of the first blade edge part 621*b*.

Moreover, the top plate (receiving member) 903 is provided at a position closer to the rotation advancing side (upper part of the housing 612 in this example) than the position of the label separating plate 902 outside the rotation trajectory r which is the rotation range of the first blade edge part 621*b* and in the rotation direction of the rotator 620. The top plate 903 is extended between the first wall surface 613 and the second wall surface 614 of the housing 612.

<Comparative Example>

Subsequently, a working effect on the basis of a configuration of each of the above described label separating shaft 901, the label separating plate 902, and the top plate 903 will be described by referring to a comparative example. FIGS. 14A-14H sequentially illustrate a tape feeding/cutting behavior along a rotation angle in the comparative example in which the shaft 901, the label separating plate 902, and the top plate 903 are not provided. A value of the rotation phase on the basis of the above described rotation phase "−20°" is indicated in each figure. In order to eliminate complexity in the illustration, reference numerals of constituent members are given only in FIG. 14A, while only the reference numeral of the label tape 3A is given and the other reference numerals are omitted in the other FIGS. 14B-14H.

Figure 14A:
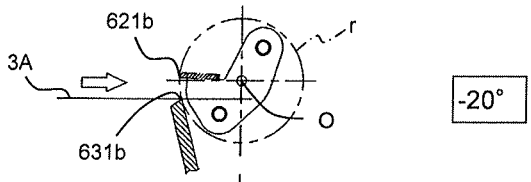
FIG. 14A is a conceptual side view illustrating feeding/cutting behaviors of the label tape executed with progress of rotation of the rotator in a comparative example not provided with the label separating shaft and the label separating plate.

First, FIG. 14A illustrates a state in which the rotation phase of the rotator 620 is "−20°". At this timing, the first blade edge part 621*b* is in a substantially horizontal state and has not arrived at the position of the second blade edge part 631*b* yet.

Figure 14B:
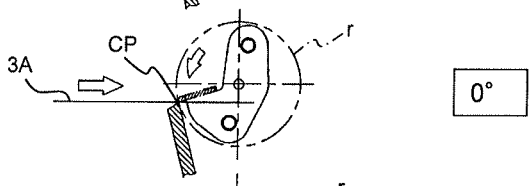
FIG. 14B is a conceptual side view illustrating feeding/cutting behaviors of the label tape executed with progress of rotation of the rotator in a comparative example not provided with the label separating shaft and the label separating plate.

FIG. 14B illustrates a state in which the rotation phase of the rotator 620 is "0°", and the first blade edge part 621*b* is in contact with and rubbed with the second blade edge part 631*b* from the upper side so as to sandwich the label tape 3A in a stable state in which preparation for cutting is complete. As a result, cutting of the label tape 3A is started. After the cutting with the rotation phase of "0°" is started, rubbing between the first blade edge part 621*b* and the second blade edge part 631*b* is performed until the rotation phase reaches approximately "16°" as described above, and linear cutting is made on the label tape 3A.

Figure 14C:
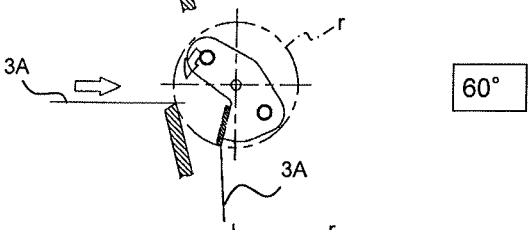
FIG. 14C is a conceptual side view illustrating feeding/cutting behaviors of the label tape executed with progress of rotation of the rotator in a comparative example not provided with the label separating shaft and the label separating plate.

FIG. 14C illustrates a state in which rotation of the rotator 620 has progressed a little from the above described state and the rotation phase of the rotator 620 is "60°". The label tape 3A is provided with the adhesive layer 3*b* as described above. As a result, the adhesive in the adhesive layer 3*b* is exposed from a cut surface during cutting with the rotation phase of "0°0", and the exposed adhesive causes an end portion (cut portion) of the label tape 3A at a cutting position CP to adhere to the first blade edge part 621*b*. As a result, the label tape 3A on the front in the transport direction (right side in the illustration) from the cut portion (that is, a cut object which becomes the print label T. The same applies to the following) is suspended in a cantilever state with respect to the first blade edge part 621*b* and rotates in the rotating direction together with the first flat blade 621 in that state as illustrated in FIG. 14C. At the same time, the (subsequent) label tape 3A located on the rear of the cut position is also fed to the front (right side in the illustration) and introduced into the inside of the rotation trajectory r of the first blade edge part 621*b*.

Figure 14D:
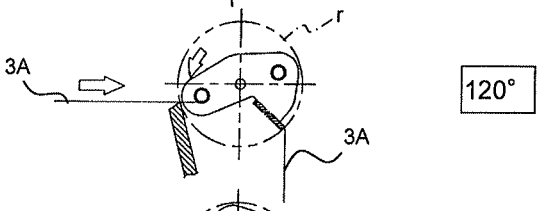
FIG. 14D is a conceptual side view illustrating feeding/cutting behaviors of the label tape executed with progress of rotation of the rotator in a comparative example not provided with the label separating shaft and the label separating plate.

FIG. 14D illustrates a state in which rotation of the rotator 620 has further progressed a little and the rotation phase of the rotator 620 is "120°". The adhering label tape 3A (cut object) keeps on rotating while accompanying the first flat blade 621. The (subsequent) label tape 3A located on the rear of the cut position is further fed to the front (right side in the illustration).

Figure 14E:
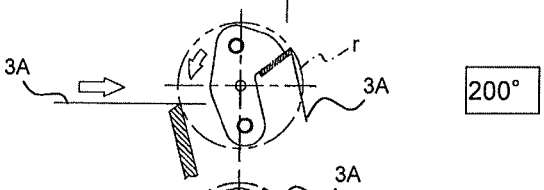
FIG. 14E is a conceptual side view illustrating feeding/cutting behaviors of the label tape executed with progress of rotation of the rotator in a comparative example not provided with the label separating shaft and the label separating plate.
Figure 14F:
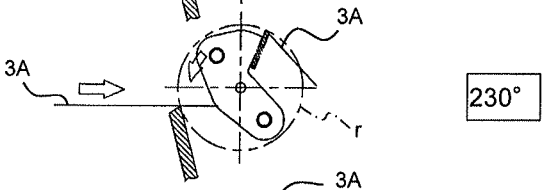
FIG. 14F is a conceptual side view illustrating feeding/cutting behaviors of the label tape executed with progress of rotation of the rotator in a comparative example not provided with the label separating shaft and the label separating plate.
Figure 14G:
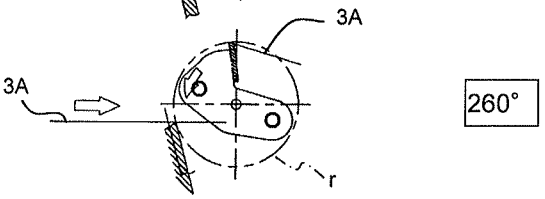
FIG. 14G is a conceptual side view illustrating feeding/cutting behaviors of the label tape executed with progress of rotation of the rotator in a comparative example not provided with the label separating shaft and the label separating plate.
Figure 14H:
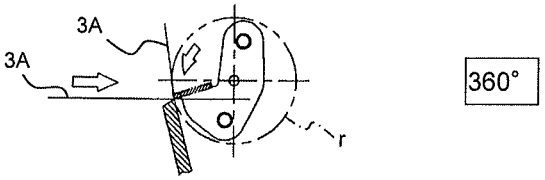
FIG. 14H is a conceptual side view illustrating feeding/cutting behaviors of the label tape executed with progress of rotation of the rotator in a comparative example not provided with the label separating shaft and the label separating plate.

Similarly, FIG. 14E illustrates a state in which rotation of the rotator 620 has further progressed a little and the rotation phase of the rotator 620 is "200°", FIG. 14F illustrates a state in which rotation of the rotator 620 has further progressed a little and the rotation phase of the rotator 620 is "230°", FIG. 14G illustrates a state in which rotation of the rotator 620 has further progressed a little and the rotation phase of the rotator 620 is "260°", and FIG. 14H illustrates a state in which the rotation phase of the rotation of the rotator 620 is "360°". As illustrated in these figures, the adhering label tape 3A (cut object) is rotating once together with the first flat blade 621 to the rotation phase of "360°" while accompanying the first blade edge part 621*b*. As a result, the cutting operation of the first flat blade 621 on the subsequent label tape 3A which is a cutting target at the time illustrated in FIG. 14H and moreover, the cutting operation of the first flat blade 621 after that are affected.

<Behavior of Embodiment>

FIGS. 15A-15G sequentially illustrate feeding/cutting behaviors of the label tape 3A in this embodiment provided with the label separating shaft 901, the label separating plate 902, and the top plate 903 along the above described rotation angle. Similarly to the above, in order to eliminate complexity in the illustration, reference numerals of constituent members are given only in FIG. 15A, while only the reference numeral of the label tape 3A is given and the other reference numerals are omitted as appropriate in the other FIGS. 15B-15H.

First, the states with the rotation phases "−20°"-"120°" illustrated in FIGS. 15A-15D are similar to the above described FIGS. 14A-14D. That is, the first blade edge part 621*b* is brought into contact with and rubbed with the second blade edge part 631*b* from the upper side, and the cutting of the label tape 3A is started. During the cutting, since the end portion (cut portion) of the label tape 3A adheres to the blade edge of the first flat blade 621, the label tape 3A (cut object) on the front in the transport direction (right side in the illustration) from the cut position rotates together with the first flat blade 621 in the rotating direction. A first side 621*c* of the first blade edge part 621*b* faces the direction of rotation and a second 621*d* of the first blade edge part 621*b* is opposite to the first side.

Figure 15A:
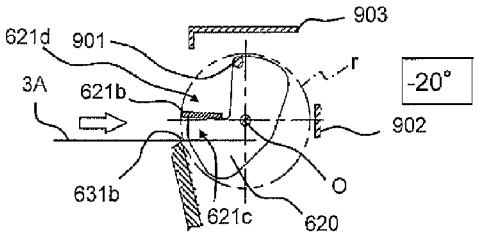
FIG. 15A is a conceptual side view illustrating feeding/cutting behaviors of the label tape executed with progress of rotation of the rotator in an embodiment provided with the label separating shaft and the label separating plate.
Figure 15B:
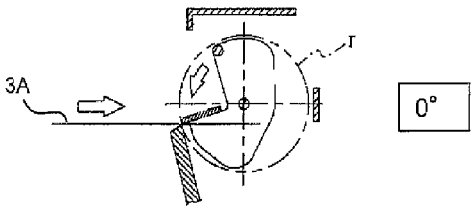
FIG. 15B is a conceptual side view illustrating feeding/cutting behaviors of the label tape executed with progress of rotation of the rotator in an embodiment provided with the label separating shaft and the label separating plate.
Figure 15C:
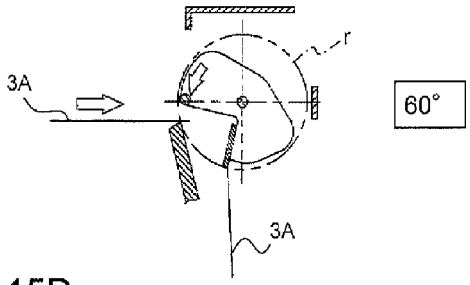
FIG. 15C is a conceptual side view illustrating feeding/cutting behaviors of the label tape executed with progress of rotation of the rotator in an embodiment provided with the label separating shaft and the label separating plate.
Figure 15D:
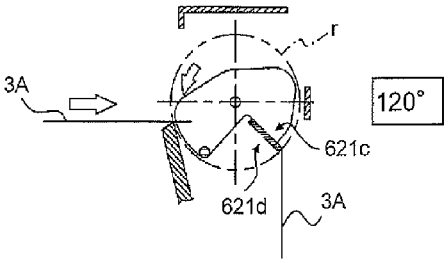
FIG. 15D is a conceptual side view illustrating feeding/cutting behaviors of the label tape executed with progress of rotation of the rotator in an embodiment provided with the label separating shaft and the label separating plate.
Figure 15E:
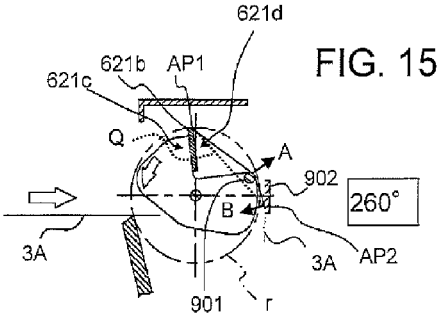
FIG. 15E is a conceptual side view illustrating feeding/cutting behaviors of the label tape executed with progress of rotation of the rotator in an embodiment provided with the label separating shaft and the label separating plate.

In this embodiment, in a state where rotation of the rotator 620 has progressed a little from the state illustrated in FIG. 15D (corresponding to a predetermined rotating direction position described in each of the claims), the label separating shaft 901 rotates with a predetermined delay phase angle (90°, for example) from the first flat blade 621, and the label separating shaft 901 is brought into contact with the label tape 3A (cut object) from inside in the radial direction (See FIG. 15E which will be described later). As a result, the label separating shaft 901 gives a reaction force to the outside in the radial direction (See an arrow A in FIG. 15E which will be described later) to the label tape 3A (cut object) adhering as above and rotating with the first flat blade 621. This state in which the reaction force is applied by the label separating shaft 901 continues until the adhesion is released as will be described above.

FIG. 15E illustrates a state in which rotation of the rotator 620 has further progressed a little and the rotation phase of the rotator 620 is "260°". In this state, the label separating plate 902 is brought into contact with the label tape 3A (cut object) from the outside in the radial direction. At this time, the label tape 3A (cut object) adhering to the first blade edge part 621*b* as described above will move to the outside in the radial direction by means of pressing by the label separating shaft 901. However, since the label separating plate 902 is brought into contact with the label tape 3A (cut object) from the outside in the radial direction as described above, subsequent movement to the outside in the radial direction of the label tape 3A (cut object) is constrained by the label separating plate 902 (See an arrow B in FIG. 15E). As a result, as illustrated in FIG. 15E, the shape of the label tape 3A (cut object) from the adhesion portion with the first blade edge part 621*b* to the contact portion (constrained portion) with the label separating plate 902 via the contact portion (reaction force applied portion) with the label separating shaft 901 becomes an arched shape expanding to the outside in the radial direction.

At this time, as illustrated in FIG. 15E, the label separating shaft 901 is provided so as to be located on the rotator 620 outside in the radial direction of a plane Q connecting an adhesion portion AP1 between the first blade edge part 621*b* and the label tape 3A (cut object) and a contact portion AP2 between the label separating plate 902 and the label tape 3A (cut object) when the label separating plate 902 is brought into contact with the label tape 3A (cut object) from the outside in the radial direction.

Figure 15F:
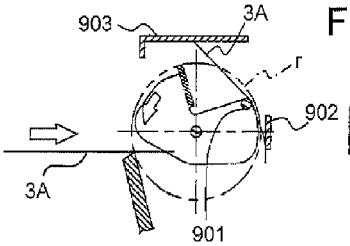
FIG. 15F is a conceptual side view illustrating feeding/cutting behaviors of the label tape executed with progress of rotation of the rotator in an embodiment provided with the label separating shaft and the label separating plate.

FIG. 15F illustrates a state in which rotation of the rotator 620 has further progressed a little and the rotation phase of the rotator 620 is "270°". As a result of the formation of the arched shape, a deflection repulsion force to escape from constraint of the label separating plate 902 described above is accumulated in the label tape 3A (cut object) with progress of the rotation after FIG. 15E, and the repulsion force to the outside in the radial direction acts on the cut portion (that is, the adhesion portion AP1 to the first blade edge part 621*b*. See FIG. 15E) of the label tape 3A. In the state illustrated in FIG. 15F, the deflection repulsion force exceeds the adhesion force at the adhesion portion AP1, whereby the adhesion is released. In this state, the end portion (cut portion) of the label tape 3A whose adhesion to the first blade edge part 621*b* is released as above is received by the top plate 903. As described above, the label tape 3A (cut object) is separated from the first blade edge part 621*b* of the first flat blade 621.

Figure 15G:
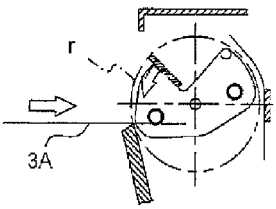
FIG. 15G is a conceptual side view illustrating feeding/cutting behaviors of the label tape executed with progress of rotation of the rotator in an embodiment provided with the label separating shaft and the label separating plate.

FIG. 15G illustrates a state in which rotation of the rotator 620 has further progressed a little and the rotation phase of the rotator 620 is "300°". The label tape 3A (cut object) released from the adhesion as above and repelling to the outside in the radial direction is received by the top plate 902 and then, separates downward from the top plate 902. After this state, as rotation of the rotator 620 further progresses, it enters the state before the cutting is started illustrated in FIG. 15A, and the same procedure is repeated.

In the above, the feeding speed of the label tape 3A and the circumferential speed of the first blade edge part 621*b* are set substantially equal, but this is not limiting. That is, if the label tape 3A is to be cut to a relatively small length, for example, the circumferential speed of the first blade edge part 621*b* may be set larger than the feeding speed of the label tape 3A.

The present disclosure is not limited to the above described embodiment but is capable of various variations in a range not departing from its gist and technical idea. The variations will be described below in order.

(1) If delay phase angle of label separating shaft is set small:

In this variation, the delay phase angle of the label separating shaft 901 from the first flat blade 621 is set smaller than that in the above described embodiment (to less than 10°, for example, in this example). That is, as illustrated in FIGS. 16A-16G, the label separating shaft 901 is arranged relatively close to the side opposite to the rotating direction of the first flat blade 621.

FIGS. 16A-16G sequentially illustrate the feeding/cutting behaviors of the label tape 3A provided with the label separating shaft 901 according to this variation along the above described rotation angle. The same reference numerals are given to the portions equal to those in the above described embodiment. Similarly to the above, in order to eliminate complexity in the illustration, reference numerals of constituent members are given only in FIG. 16A, while only the reference numeral of the label tape 3A is given and the other reference numerals are omitted in the other FIGS. 16B-16H.

First, since FIGS. 16A-16D illustrate behaviors substantially equal to those in FIGS. 15A-15D in the above described embodiment, explanation will be omitted. In a state in which rotation of the rotator 620 has progressed a little (corresponding to the predetermined rotating direction position described in each of the claims) from the state illustrated in FIG. 16D, the label separating shaft 901 rotates with a predetermined delay phase angle (however, a small value less than 10° in this example) from the first flat blade 621 and thus, is brought into contact with the label tape 3A (cut object) from inside in the radial direction (See FIG. 16E which will be described later). As a result, the label separating shaft 901 applies a reaction force to the outside in the radial direction to the label tape 3A (cut object) adhering to and rotating with the first flat blade 621 (See an arrow C in FIG. 16E which will be described later). This state in which the reaction force is applied by the label separating shaft 901 continues until the adhesion is released as will be described above.

Figure 16A:
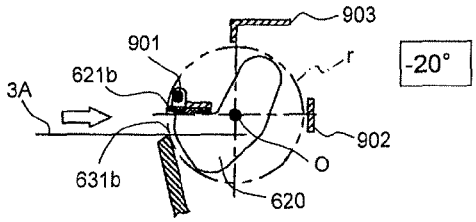
FIG. 16A is a conceptual side view of the rotary cutter device according to a variation in which a delay phase angle of the label separating shaft is set small.
Figure 16B:
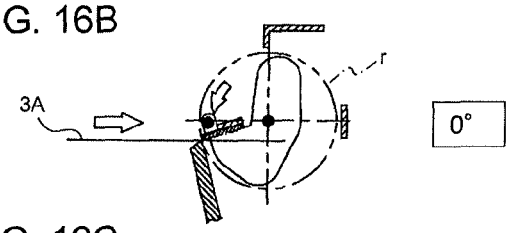
FIG. 16B is a conceptual side view of the rotary cutter device according to a variation in which a delay phase angle of the label separating shaft is set small.
Figure 16C:
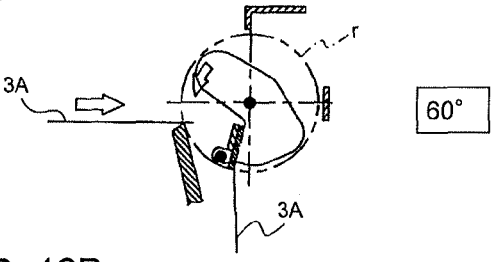
FIG. 16C is a conceptual side view of the rotary cutter device according to a variation in which a delay phase angle of the label separating shaft is set small.
Figure 16D:
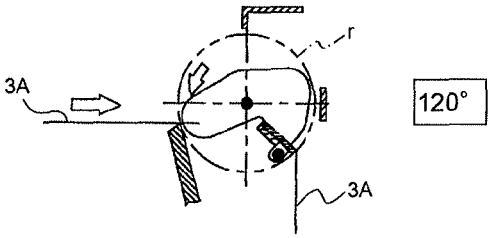
FIG. 16D is a conceptual side view of the rotary cutter device according to a variation in which a delay phase angle of the label separating shaft is set small.
Figure 16E:
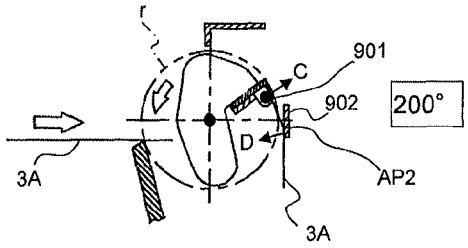
FIG. 16E is a conceptual side view of the rotary cutter device according to a variation in which a delay phase angle of the label separating shaft is set small.

FIG. 16E illustrates a state in which rotation of the rotator 620 has further progressed a little from the above and the rotation phase of the rotator 620 is "200°". In this state, the label separating plate 902 is brought into contact with the label tape 3A (cut object) from the outside in the radial direction. The label tape 3A (cut object) still adhering to the first blade edge part 621*b* will move to the outside in the radial direction by means of pressing by the label separating shaft 901. Similarly to the above, since the label separating plate 902 is brought into contact with the label tape 3A (cut object) from the outside in the radial direction at the time, subsequent movement of the label tape 3A (cut object) to the outside in the radial direction is constrained by the label separating plate 902 (See an arrow D in FIG. 16E). As a result, as illustrated in FIG. 16E, the shape of the label tape 3A (cut object) from the adhesion portion with the first blade edge part 621*b* to the contact portion AP2 with the label separating plate 902 via the contact portion with the label separating shaft 901 becomes an arched shape expanding to the outside in the radial direction.

Figure 16F:
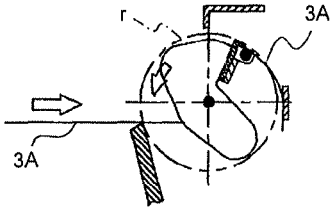
FIG. 16F is a conceptual side view of the rotary cutter device according to a variation in which a delay phase angle of the label separating shaft is set small.

FIG. 16F illustrates a state in which rotation of the rotator 620 has further progressed a little from the above and the rotation phase of the rotator 620 is "230°". As a result of the formation of the arched shape, similarly to the above, a deflection repulsion force to escape from constraint of the label separating plate 902 described above is accumulated in the label tape 3A (cut object) with progress of the rotation after FIG. 16E, and the repulsion force to the outside in the radial direction acts on the cut portion (that is, the adhesion portion AP1 to the first blade edge part 621*b*. See FIG. 16E) of the label tape 3A.

Figure 16G:
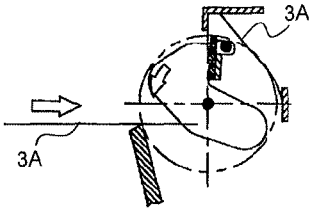
FIG. 16G is a conceptual side view of the rotary cutter device according to a variation in which a delay phase angle of the label separating shaft is set small.

After that, in the state illustrated in FIG. 16G in which rotation of the rotator 620 has further progressed a little from the above and the rotation phase of the rotator 620 is "240°", the deflection repulsion force exceeds the adhesion force at the adhesion portion AP1, whereby the adhesion is released. In this state, the end portion (cut portion) of the label tape 3A whose adhesion to the first blade edge part 621*b* is released as above is received by the top plate 903. As described above, in this variation, too, the label tape 3A (cut object) is separated from the first blade edge part 621*b* of the first flat blade 621 by means of the method similar to that in the above described embodiment.

In this variation, too, the same effects as those in the above described embodiment are obtained. That is, due to the constraint by collaboration of the pressing contact of the label separating shaft 901 and the label separating plate 902, the deflection repulsion force is accumulated in the label tape 3A (cut object). When the rotator 620 reaches a given rotating direction position and the deflection repulsions force exceeds the adhesion force at the adhesion portion, the label tape 3A can be easily separated from the first blade edge part 621*b*. As a result, a smooth subsequent cutting operation can be ensured.

Figure 17:
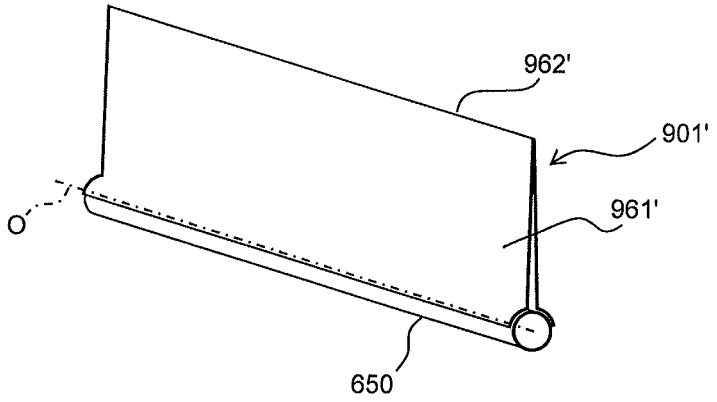
FIG. 17 is a perspective view illustrating a variation using a film member as a rotation-side separating member.

(2) If rotation-side separating member is composed by using film:

That is, as illustrated in FIG. 17, a film member 901' bent having a substantially a-shape is used as a rotation-side separating member (instead of the above described label separating shaft 901) in this variation. At this time, the bent portion in the film member 901' becomes a distal end part 962', and base parts 961' on the both sides sandwiching this distal end part 962' is fixed to the rotary shaft 650. The distal end part 962' is brought into contact with the label tape 3A (cut object) from the inside in the radial direction similarly to the above and presses it to the outside in the radial direction. By using such film member 901', too, the same effects as those with the label separating shaft 901 in the above described embodiment can be obtained.

Figure 18:
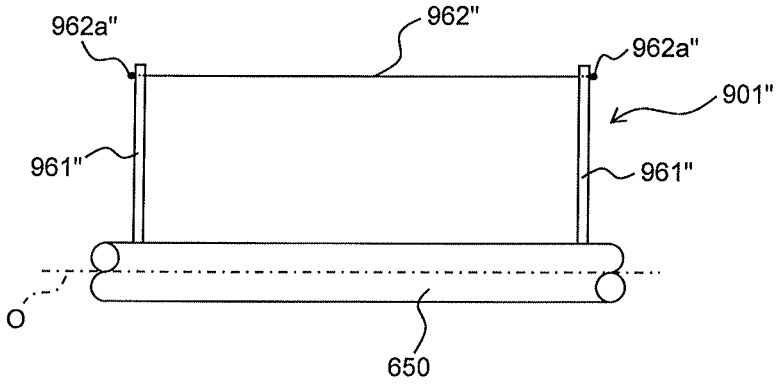
FIG. 18 is a perspective view illustrating a variation using a support structural body provided with a wire as the rotation-side separating member.

(3) If rotation-side separating member is composed by using a wire or the like:

That is, as illustrated in FIG. 18, a support structural body 901" using a wire (or a piano wire or the like) as a rotation-side separating member (instead of the label separating shaft 901) is used in this variation. That is, the support structural body 901" is composed of two arm-shaped base parts 961" provided in the radial direction at symmetric positions of the rotary shaft 650 and a wire 962" extending between the two base pars 961" and fixed through fixtures 962*a*". The wire 962" is brought into contact with the label tape 3A (cut object) from the inside in the radial direction and presses it to the outs de in the radial direction. By means of such support structural body 901", too, the same effects as those with the label separating shaft 901 in the above described embodiment can be obtained.

(4) Others

In the above, the example was explained in which the present disclosure is applied to the rotary cutter device 610 configured such that the planar direction of the second base part 631*a* of the second flat blade 631 is made parallel with the rotation axis O with a predetermined interval, and a straight line including the second blade edge part 631*b* and the rotation axis O are arranged having the predetermined angle $\alpha$ when seen from the side face direction orthogonal to the planer direction of the second base part 631*a*, but this is not limiting. That is, the present disclosure may be applied to the rotary cutter device 610 having the rotator 620 having a flat-blade mounting part 624 arranged at a position spaced away from the rotation axis O on the plane crossing the rotation axis O and arranged with inclination with respect to the rotation axis O so that the radial dimension of the rotation trajectory by an end portion on one side is larger than the radial dimension of the rotation trajectory by an end portion on the other side and a flat-blade support part for supporting the first flat blade 621 with respect to the flat-blade mounting part 624 so that an end portion on one side and an end portion on the other side form rotation trajectories having the same diameters by having the end portion on the other side of the first flat blade 621 corresponding to the other side of the flat-blade mounting part 624 provided protruding largely in the peripheral direction than the end portion on one side of the first flat blade 621 corresponding to one side of the flat-blade mounting part 624, and the holding body 630 is provided with the holding part 632 capable of holding the second flat blade 631 so as to be substantially parallel with the rotation axis O with a predetermined interval.

In the rotary cutter device 610 with the above described configuration, too, the end portion on one side of the first flat blade 621 and the end portion on the other side of the first flat blade 621 form the rotation trajectories having the same diameters, and as a result, the first flat blade 621 of the rotator 620 rotates keeping substantially the same distance from the rotation axis O over the whole region from one side to the other side. Therefore, by introducing the label tape 3A at a position spaced away by a predetermined distance which is the same from the rotation axis O, substantially linear cutting can be made on the label tape 3A over the whole region from one side to the other side of the first flat blade 621. By providing the label separating shaft 901 and the like similar to the above in such rotary cutter device 610, the same effects as those in the above can be obtained.

In the above, the print label T was produced by applying print on the label tape 3A and cutting it, but this is not limiting. That is, the present disclosure may be applied to a method of producing the print label T by bonding a tape with print as the label tape 3A on which print has been applied to the base tape and by cutting the bonded tape (so-called laminate type). In this case, too, the same effects are obtained.

In the above, arrows illustrated in FIG. 4 indicate an example of flows of signals and are not intended to limit the flow directions of the signals.

Moreover, other than those already described above, the above described embodiment and methods according to the variations may be combined as appropriate and used.

Though not specifically exemplified, the present disclosure is put into practice with various changes within the range not departing from its gist.

What is claimed is:

1. A rotary cutter device comprising:

a housing:

a rotator supported by said housing rotatably in a predetermined rotating direction and having a rotary blade including a first blade edge part; and a holding body supported by said housing and having a fixed blade including a second blade edge part, wherein said first blade edge part is brought into contact with said second blade edge part from one side in said rotating direction and the first blade edge part and the second blade edge part are rubbed with each other so as to cut an object to be cut located in a path passing through the vicinity of said second blade edge part to have a cut object; and a rotation-side separating member is provided on said rotator by a predetermined delay phase angle from said rotary blade and brought into contact with said cut object in which a cut portion of the cut object adheres to said first blade edge part during said cutting on a first side of said first blade edge part facing a direction of rotation and rotating together with said rotary blade and applying a reaction force to said cut object toward a second side opposite to said first side, and a fixed-side separating member is fixed to said housing so as to be located outside a rotation range of said first blade edge part of said rotator and in the vicinity of a rotation radius of the first blade edge part, and is brought into contact with said cut object from said first side and constrains movement of said cut object to the second side.

2. The rotary cutter device according to claim 1, wherein:

said rotation-side separating member starts contact with said cut object at a predetermined position in the rotating direction of said rotator and continues the application of said reaction force to the cut object toward said second side after the position in the rotating direction.

3. The rotary cutter device according to claim 2, wherein:

said rotation-side separating member is provided on said rotator so that, when said fixed-side separating member is brought into contact with said cut object from said second side, said rotation-side separating member is located on said second side from a plane, the plane connecting an adhesion portion where said first blade edge part and said cut object adhere to each other and a contact portion where said fixed-side separating member and said cut object contact with each other.

4. The rotary cutter device according to claim 1, further comprising:

a receiving member provided on said housing so as to be located outside the rotation range of said first blade edge part of said rotator and be located closer to a rotation advancing side than said fixed-side separating member in said rotating direction of said rotator, and configured to receive said cut portion of said cut object whose adhesion to said first blade edge part is released.

* * * * *